US010589757B2

(12) United States Patent
Thompson et al.

(10) Patent No.: US 10,589,757 B2
(45) Date of Patent: Mar. 17, 2020

(54) COIL RAILCAR WITH FLOATING FLOOR SHEET

(71) Applicant: JAC Operations, Inc., Chicago, IL (US)

(72) Inventors: William Thompson, Loretto, PA (US); Glenn J. Fowler, Larrolltown, PA (US); Michael H. Kress, Armagh, PA (US)

(73) Assignee: JAC OPERATIONS, INC., Chicago, IL (US)

( * ) Notice: Subject to any disclaimer, the term of this patent is extended or adjusted under 35 U.S.C. 154(b) by 0 days.

(21) Appl. No.: 16/401,217

(22) Filed: May 2, 2019

(65) Prior Publication Data

US 2019/0256111 A1 Aug. 22, 2019

Related U.S. Application Data

(63) Continuation of application No. 15/420,075, filed on Jan. 30, 2017, now Pat. No. 10,315,667.

(60) Provisional application No. 62/287,944, filed on Jan. 28, 2016.

(51) Int. Cl.
*B61D 3/16* (2006.01)
*B61D 45/00* (2006.01)

(52) U.S. Cl.
CPC ..... *B61D 3/16* (2013.01); *B61D 45/003* (2013.01)

(58) Field of Classification Search
CPC ..... B61D 3/16; B61D 3/166; B61D 45/003; B60P 3/035; B60P 7/12; B61L 27/00; B61L 5/005; B61B 13/12; B61B 3/02
See application file for complete search history.

(56) References Cited

U.S. PATENT DOCUMENTS 1,850,597 A * 3/1932 McGuire ..... B61D 45/003 410/48
2,810,602 A * 10/1957 Abrams ..... B60P 3/055 105/422
3,291,073 A * 12/1966 James ..... B61D 45/008 410/49
3,693,554 A * 9/1972 O'Leary ..... B61D 45/00 105/414
3,715,993 A * 2/1973 Orlik ..... B61D 45/003 410/48
4,451,188 A * 5/1984 Smith ..... B61D 45/002 410/42

(Continued)

OTHER PUBLICATIONS

United States International Trade Commission, Industry & Trade Summary, http://www.usitc.gov/publications/332/ITS-08.pdf, Publication ITS-08, Mar. 2011.

*Primary Examiner* — Jason C Smith
(74) *Attorney, Agent, or Firm* — Blynn L. Shideler; Krisanne Shideler; BLK Law Group

(57) ABSTRACT

A transverse trough coil car includes a plurality of transverse troughs, a pair of trucks, a center sill supported on the trucks, a pair of side walls extending the length of the car coupled to the center sill, and a plurality of trough forming assemblies with each trough forming assembly including at least one floating floor sheet. Each one floating floor sheet is structured to allow for thermal expansion in a first direction along a longitudinal axis of the car body and in a second direction transverse to the longitudinal axis of the car body.

20 Claims, 3 Drawing Sheets

(56) References Cited

U.S. PATENT DOCUMENTS

| | | | | |
|---|---|---|---|---|
| 6,543,368 | B1 * | 4/2003 | Forbes | B61D 3/16 105/396 |
| 9,387,864 | B2 | 7/2016 | Lydic et al. | |
| 2015/0083020 | A1 * | 3/2015 | Lydic | B60P 3/035 105/355 |
| 2017/0217450 | A1 * | 8/2017 | Thompson | B61D 3/16 |

* cited by examiner

COIL RAILCAR WITH FLOATING FLOOR SHEET

FIELD OF THE INVENTION

The present application is a continuation of claims the benefit of U.S. patent application Ser. No. 15/420,075 filed Jan. 30, 2017 titled "Coil Railcar with Floating Floor", now U.S. Pat. No. 10,315,667, and which published Aug. 3, 2017 as publication 2017-0217450, which publication and application are incorporated herein by reference. U.S. patent application Ser. No. 15/420,075 claims the benefit of U.S. Provisional Patent Application Ser. No. 62/297,944 filed Jan. 28, 2016 titled "Coil Railcar with Floating Floor."

FIELD OF THE INVENTION

The present invention relates to coil railcars with features accommodating thermal expansion.

BACKGROUND OF THE INVENTION

Freight railroad cars are critical to the economic well-being and global competitiveness of any industrialized country. For example, freight railroad cars move an estimated 42 percent of the United State's freight (measured in ton-miles) more than any other mode of transportation. Essentially all goods are shipped by rail—everything from lumber to vegetables, coal to orange juice, grain to automobiles, and chemicals to scrap iron. Freight carrying railcars connect businesses with each other across most countries and connect business within such countries with outside markets.

Rail provides major advantages in energy efficiency over other modes. On average, railroads are three times more fuel efficient than road transportation, e.g., trucks. Railroads are environmentally friendly as the U.S. Environmental Protection Agency (EPA) estimates that for every ton-mile, a typical automotive truck emits roughly three times more nitrogen oxides and particulates than a locomotive. Other studies suggest trucks emit six to 12 times more pollutants per ton-mile than do railroads, depending on the pollutant measured. Railroads have a clear advantage in terms of greenhouse gas emissions. According to the Environmental Protection Agency (EPA), railroads account for just 9 percent of total transportation-related NOx emissions and 4 percent of transportation-related particulate emissions, even though they account for 42 percent of the nation's intercity freight ton-miles.

Further, freight railroads significantly alleviate highway congestion. A single intermodal train takes up to 280 trucks (equivalent to more than 1,100 cars) off associated highways; a train carrying other types of freight takes up to 500 trucks off the associated highways. It has been noted that overcrowded highways act as an "inefficiency tax" on our economy, seriously constraining economic growth. Freight railroads help relieve this restriction by reducing gridlock, enhancing mobility, and reducing the pressure to build costly new highways.

Finally, railroads have major safety advantages over other modes. For example, railroads are the safest way to transport hazardous materials. In the United States, railroads and trucks carry roughly equal hazmat ton-mileage, but trucks have nearly 16 times more hazmat releases than railroads. Thus there is a need to continue to improve and revitalize the freight car industry.

Focusing on improving the manufacturing process and car design and assembly can decrease associated costs and assembly time. It has been reported by the Highland Group that the implementation of lean manufacturing techniques and just in time inventory procedures to a railcar fabrication center was able to increase production at the facility of about 50%. This increase in efficiency can be further enhanced or supplemented with improved product design that attempt to maximize efficiency without altering railcar capacity or operation.

Coil cars are a specialized type of railcars, or rolling stock designed primarily for the transport of coils (i.e., rolls) of sheet metal, most commonly steel coils. For an overview of all freight car developments within the United States and associated industry trends see United States International Trade Commission 2011 report on Rolling Stock: Locomotives and Rail Cars (see http://www.usitc.gov/publications/332/ITS-08.pdf). Coil cars are often are considered a subtype of the gondola car, though coil cars bear little resemblance to a typical gondola. A gondola is generally an open-top type of rolling stock that is typically used for carrying loose bulk materials, while coil cars carry items such as plates or coils, or bulky items such as prefabricated pieces of rail track.

Prior to the development, and wide adoption, of coil cars, coils of sheet steel were carried on end or in cradles in open or covered gondolas. Load shifting, damage, and awkward loading and unloading were all problems with this type of loading, and since so much sheet steel is transported, a specialized car was designed for this use.

The body of a coil car consists of at least one trough, or a series of troughs, and may be lined with wood or other material to cushion the carried coils. The coils are set on their sides and supported by the sides forming the trough, and stops may be applied to keep the coils from shifting. Often the trough or pair of troughs are positioned longitudinal relative to the railcar as shown, for example, in U.S. Pat. Nos. 4,451,188 and 6,543,368, which are incorporated herein by reference.

The longitudinal placement of the troughs in a coil car can mean that the coils can be shifted in the trough due to the acceleration and deceleration and impact forces exerted due to the car motion along the track. Thus, in some instances, the coils are carried with their axes transverse to the direction of travel of the car. Representative examples of this construction include U.S. Pat. Nos. 1,850,597; 3,291,073 showing a coil skid design; U.S. Pat. No. 3,693,554 discloses a rail flat car with a plurality of transverse bulkheads; and U.S. Pat. No. 3,715,993 in which the cylindrical objects are cable reels. These patents are also incorporated herein by reference. Transverse coil cars typically have a number of parallel troughs, rather than one or two long trough(s). Each trough is generally V-shaped, and the coil sits in the transverse trough with the outer circumference of the coil tangent to the V at two points such that it cannot roll. The V-shaped troughs are generally lined, such as with wood decking to act as cushioning, thereby discouraging damage to the coils during loading or travel.

Applicant's U.S. Pat. No. 9,387,864 discloses a transverse trough coil car with improved trough construction, and is incorporated herein by reference (see also Publication number 2015-0083020 and PCT/US2013/034947 which are incorporated herein by reference).

U.S. Pat. No. 2,810,602 discloses a trailer vehicle body which includes transverse laden supports and is also of general interest to the present invention.

FIG. 1 is a sectional side view of a conventional or prior art transverse coil car 10. This railcar 10 includes an open top body 12 on a pair of spaced trucks 14. As illustrated in this figures the body includes a center sill, pair of side sills, pair of top chords, a pair of side walls extending between each top chord and an associated side sill. The body in this example includes nine transverse troughs 16 that are each designed around a specific range of coils 18.

One difficulty with the illustrated construction of FIG. 1 is that a new car design must be developed essentially from scratch for changes in trough number or size. Traditionally traverse trough coil cars 10 are designed with a specific number of trough pockets 16 and each trough pocket configured to a particular minimum and maximum coil 18 diameter ranges. These troughs 16 on a coil car 10 often are configured with several different coil 18 diameter ranges often to maximize the efficiency of the associated design, and typically the resulting car 10 is associated with a specific custom design and results in many specialized parts for construction of the car 10. The design of the custom parts and fixtures adds to the design time and the fabrication time associated with the car design.

There remains a need in the industry to provide car designers with modular assemblies allowing new car designs to be easily implemented saving both design and manufacturing time and money.

SUMMARY OF THE INVENTION

The present invention is directed to a transverse trough coil car which includes a plurality of transverse troughs along the car body. The car includes a pair of trucks, a center sill supported on the trucks and extending substantially the longitudinal length of the car, a pair of side walls extending the longitudinal length of the car on opposed sides of the car and coupled to the center sill, each side wall including a side sill, top chord and side plate extending between the top chord and the side sill, and a plurality of trough forming assemblies, with each trough forming assembly including at least one floating floor sheet.

Floating with regard to the floor sheets of the present invention mean that the floor sheet is coupled to the associated structure in a manner so as to accommodate thermal expansion in a length and width direction of the floor sheet.

These and other advantages of the present invention will be described in connection with that attached figures in which like reference numeral represent like elements throughout.

BRIEF DESCRIPTION OF THE DRAWINGS

For a better understanding of the present invention and to show more clearly how it may be carried into effect, reference will now be made by way of example to the accompanying drawings, which show an apparatus according to the preferred embodiment of the present invention and in which.

DETAILED DESCRIPTION OF THE INVENTION

Figure 1:
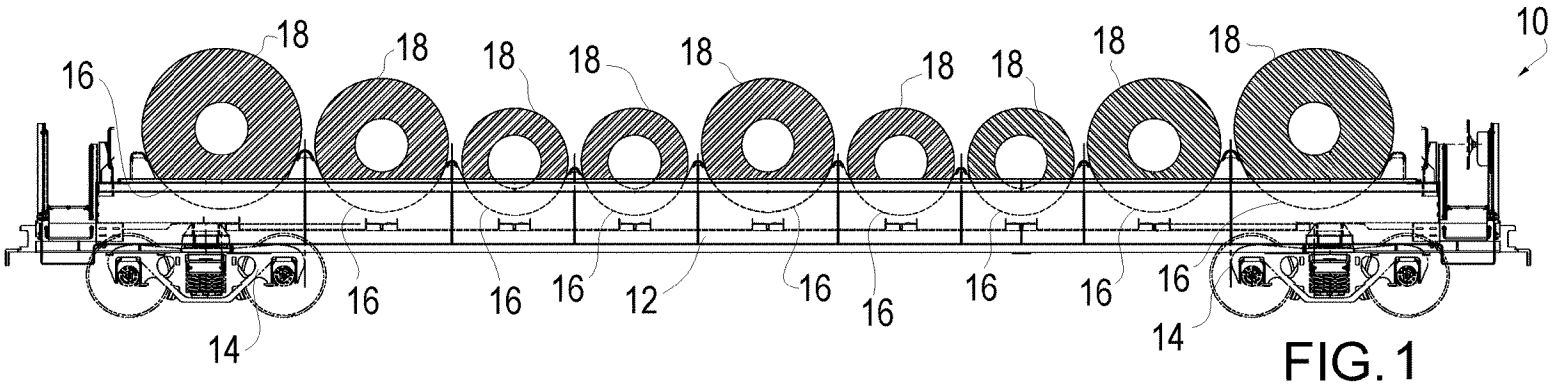
FIG. 1 PRIOR ART
FIG. 1 is a sectional side view of a prior art transverse coil car.
Figure 2:
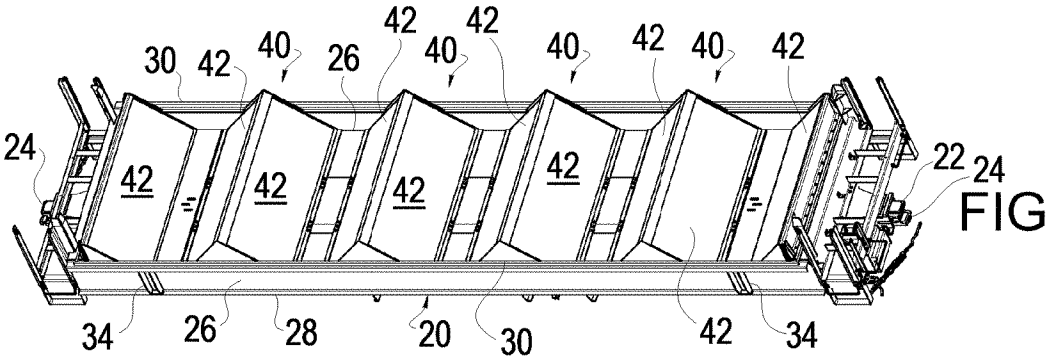
FIG. 2 is a top perspective view of a transverse trough coil railcar body with trough forming assemblies having floating floor sheet in accordance with one aspect of the present invention.
Figure 3:
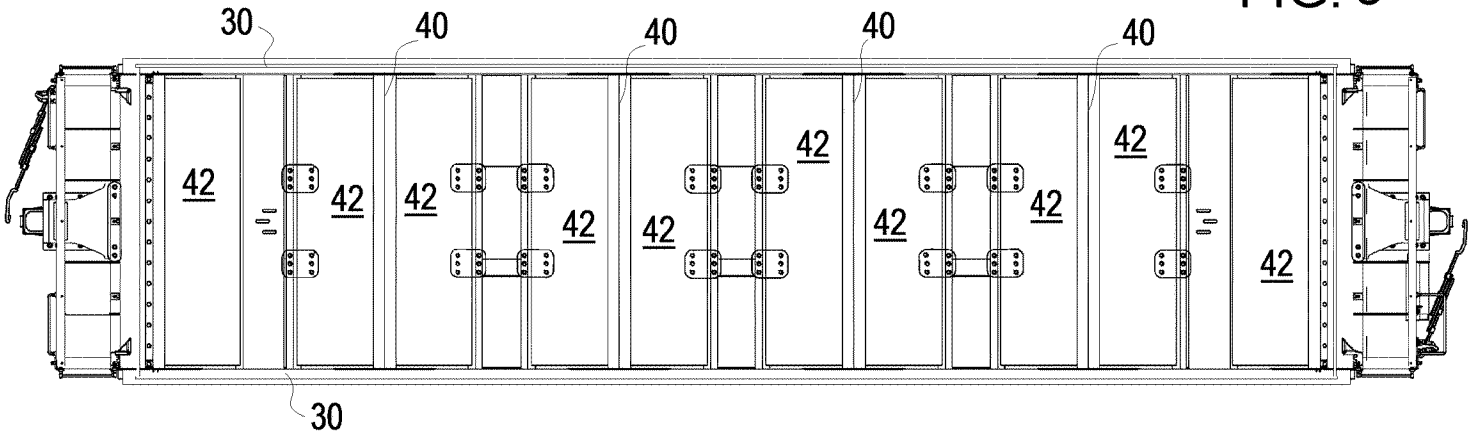
FIG. 3 is a top plan view of the transverse trough coil railcar body of FIG. 2.
Figure 4:
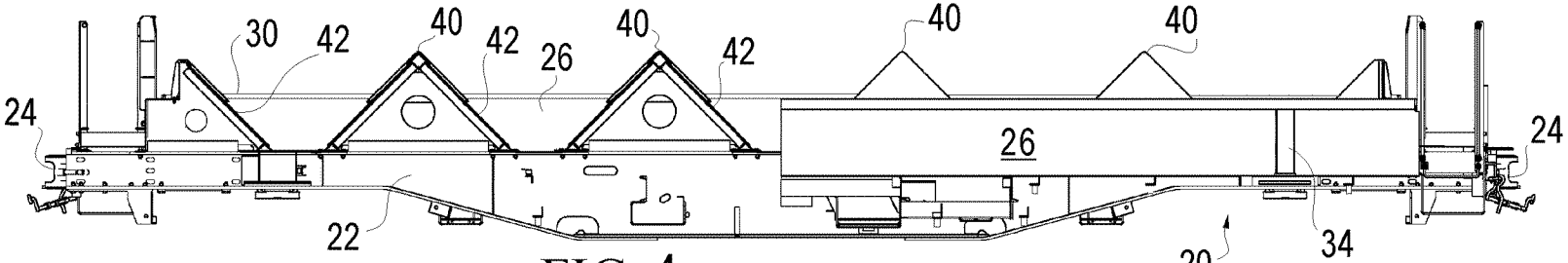
FIG. 4 is a side elevation view, partially in section, of the transverse trough coil railcar body of FIG. 2.
Figure 6:
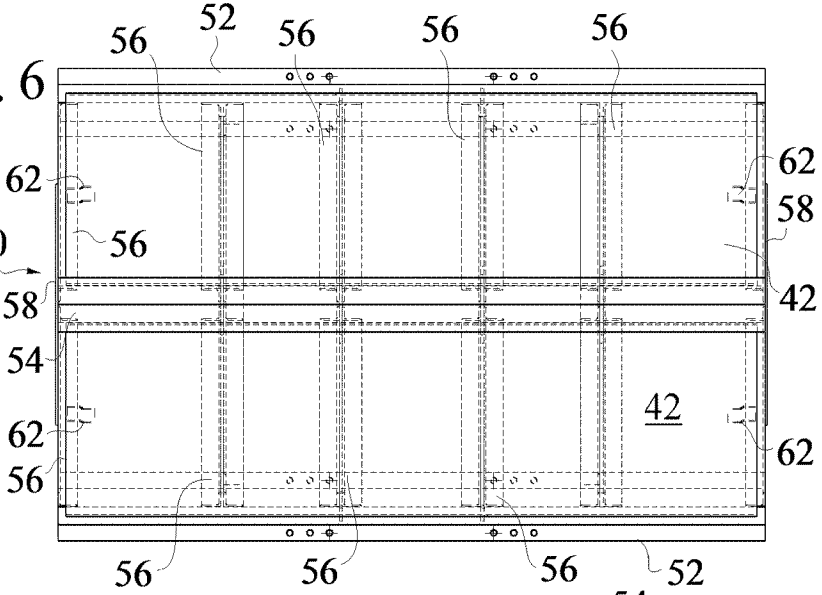
FIG. 6 is a top plan view of the trough forming assembly of FIG. 5.
Figure 7:
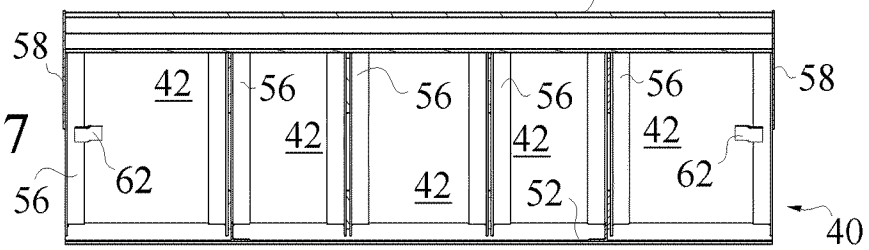
FIG. 7 is a sectional view of the trough forming assembly of FIG. 5.
Figure 5:
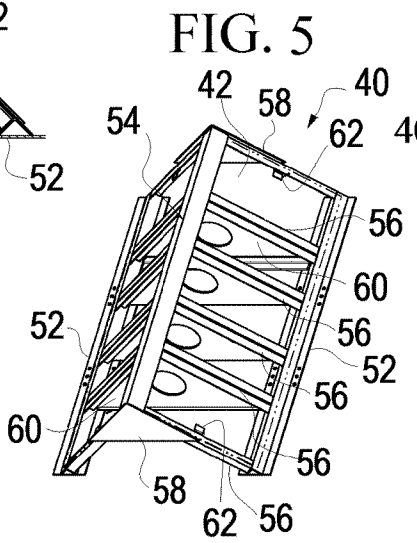
FIG. 5 is a perspective view of a trough forming assembly of the transverse trough coil railcar body of FIG. 2 with the floating floor sheets removed.
Figure 9:
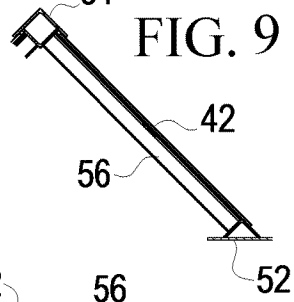
FIG. 9 is a sectional view of a portion of the trough forming assembly of FIG. 5.
Figure 10:
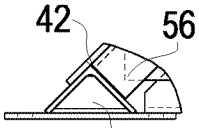
FIG. 10 is a sectional view of a portion of the trough forming assembly of FIG. 5.
Figure 8:
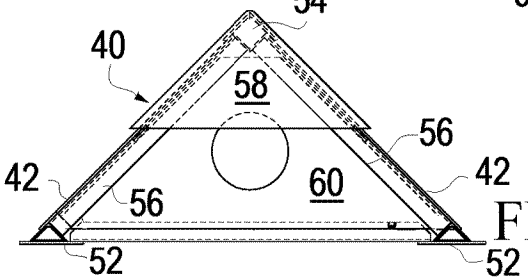
FIG. 8 is an end view of the trough forming assembly of FIG. 5.
Figure 13:
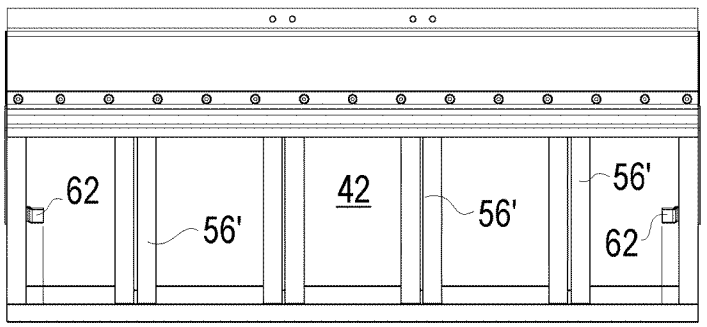
FIG. 13 is a rear elevational view of the end trough forming assembly of FIG. 11 with a rear covering removed.
Figure 12:
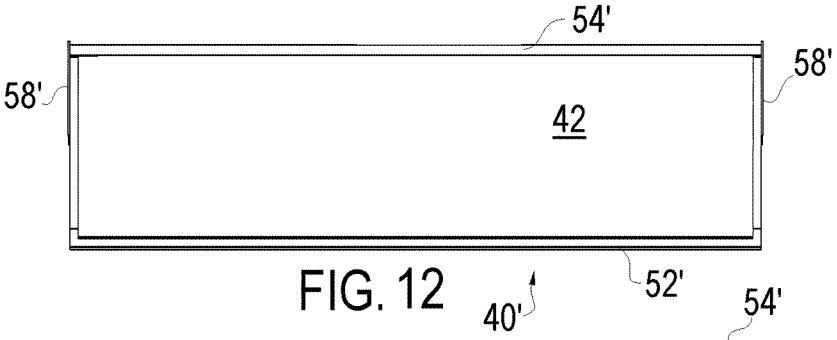
FIG. 12 is a front elevational view of the end trough forming assembly of FIG. 11.
Figure 16:
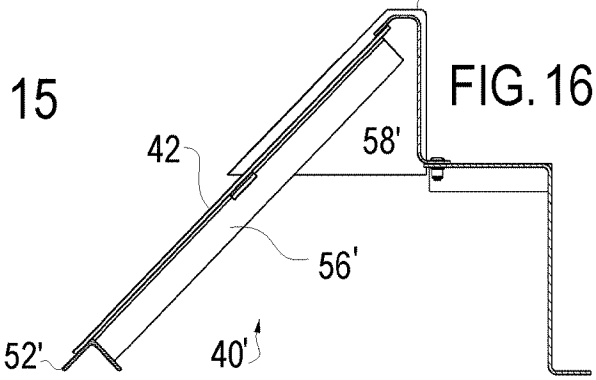
FIG. 16 is an end sectional view of the end trough forming assembly of FIG. 11.
Figure 15:
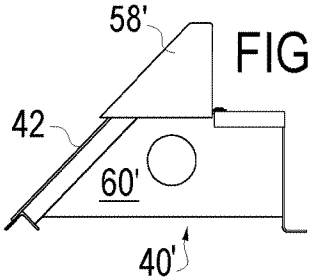
FIG. 15 is an end view of the end trough forming assembly of FIG. 11.
Figure 11:
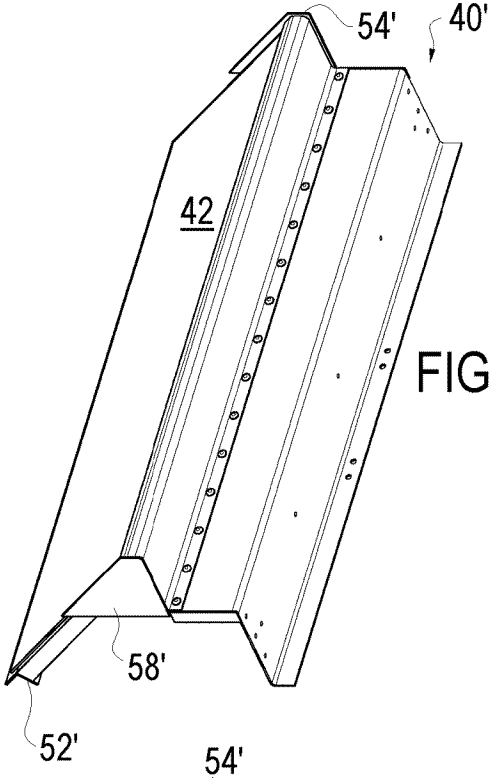
FIG. 11 is a perspective view of an end trough forming assembly of the transverse trough coil railcar body of FIG. 2.
Figure 14:
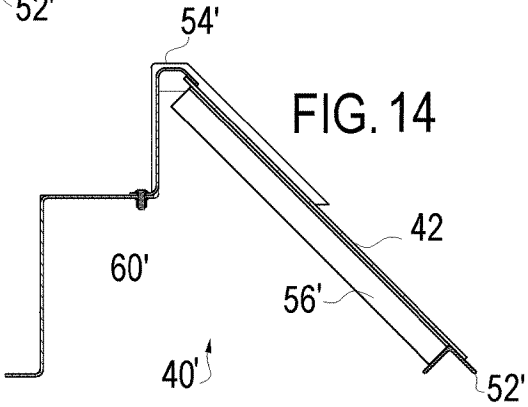
FIG. 14 is a end sectional view of the end trough forming assembly of FIG. 11.

FIGS. 2-4 illustrate a transverse trough coil railcar body 20 with trough forming assemblies 40 (including the end trough forming assemblies 40') with floating floor sheets 42 in accordance with one aspect of the present invention. The railcar of the invention includes an under-frame having a conventional center sill 22 supported on a conventional pair of spaced trucks 14 (shown in FIG. 1) and extending substantially the longitudinal length of the car body 20. It is also known to have two railcar bodies share three trucks, or even four railcar bodies share five trucks and the body 20 and trucks 14 could be formed similarly, however even in these arrangements each single body 20 is associated with a given pair of trucks 14.

A truck 14 (also known as bogies), in railroading, references the railroad car wheel assembly usually having two or more axles and which typically rotate freely beneath the cars in order to allow the cars to navigate turns.

The center sill 22 is generally a box shaped in cross-section and may be considered the main structural member of the railcar. The center sill 22 runs from one end coupling 24 (also known as couplers) of the car to the other. The center sill 22 is the primary load path of the car both for longitudinal buff and draft loads from coupler to coupler, and for carrying the vertical load bending moment between the trucks. See examples in U.S. Pat. Nos. 7,861,659; 6,119,345; 5,860,366; 4,565,135; 4,493,266 and 4,194,451 which are incorporated herein by reference.

The transverse trough coil railcar body 20 includes a pair of side walls 26 extending the longitudinal length of the car body 20 on opposed sides of the car, each side wall 26 including a side sill 28, top chord 30, and side plates extending between the top chord 30 and the side sill 28. Side stakes 34 may be provided to further support the side plates.

The side plates may be formed of a number of distinct plate members as needed. The construction of the side walls 26 is generally known in the art as is the end construction and intermediate cross supports (not shown) coupling the side sills 28 of the side walls 26 to the center sill 22. The top chords 30 and side sills 28 may be open or closed structural members and may be formed as composite members as known in the art.

A significant aspect of the present invention is the inclusion of a plurality of trough forming assemblies 40, including the end trough forming assemblies 40', each including floating floor sheets 42 in accordance with one aspect of the present invention. The trough forming assembly 40 is shown in detail individually in FIGS. 5-10, while the end trough forming assembly 40' is shown in detail individually in FIGS. 11-16.

The trough forming assembly 40 may be considered modular trough forming assemblies 40, analogous to that described in U.S. Pat. No. 9,387,864, allowing for reducing the fabrication costs, inventory costs and assembly time for each distinct car design. The modular trough forming assemblies 40 can be used to form essentially any desired number transverse troughs appropriate for the car. Increasing or decreasing the lateral distance between adjacent trough forming assemblies 40 creates larger or smaller pockets there between without requiring specialized components or requiring customized parts. A pair of adjacent trough forming assemblies 40 (or a trough forming assembly 40 and an end trough forming assembly 40') forms a pocket or trough.

Each trough forming assembly 40, shown in FIGS. 5-10, includes a generally triangular frame formed with a pair of base members 52 and a ridge member 54 with frame supports 56 extending between one of the base members 52 and the ridge member 54. Side members 58 coupled to the ends of the ridge member 54 and sides of the outermost frame supports 56 cap the sides of each trough forming assembly 40. Gusset or support plates 60 are provided along the length at the location of the frame supports 56 to provide a rigid structure.

The floating floor sheets 42 are coupled to trough forming assembly 40 in a manner to allow for thermal expansion in the length and width direction of the floor sheet 42 as noted above, floating with regard to the floor sheets 42 of the present invention define that the floor sheet 42 is coupled to the associated structure in a manner so as to accommodate thermal expansion in a length and width direction of the floor sheet 42. The floor sheets 42 may be effectively formed from ASTM A-572 Grade 60 for most coil car applications. For example the floor sheet 42 may be supported on the base member 52 via a series of angles or stops 66 welded to the sheet 42 in a manner (between plates 60 and supports 56) to allow expansion of the sheet 42 as needed. Expansion room under the ridge member 54 allows for expansion in this direction, and the ridge member 54 retaining the floor sheet. The outermost frame members 56 engage with floor sheet clips 62 that are welded to the floor sheet 42 to support and retain the floating floor sheets 42 in a manner allowing side to side expansion. In other words the clips 62 secure the floor sheets 42 but allow expansion side to side (as does the resting stops 66). The floor sheets 42 are thus floating on the trough forming assembly 40

One end trough forming assembly 40' is shown in detail individually in FIGS. 11-16 and each is roughly analogous to the trough forming members 40 accept with only a single floating floor sheet 42 and associated structure and a non-triangular frame. Each end trough forming assembly 40' includes a generally frame formed with a single base member 52' and a ridge member 54' with frame supports 56' extending the base member 52' and the ridge member 54'. Side members 58' coupled to the ends of the ridge member 54' and sides of the outermost frame supports 56' cap the sides of each end trough forming assembly 40'. Gusset or support plates 60' are provided along the length at the location of the frame supports 56' to provide a rigid structure. The floating floor sheet 42 is coupled to the end trough forming assembly 40' in a manner to allow for thermal expansion in the length and width direction of the floor sheet 42 as noted above. For example the floor sheet 42 may be supported on the base member 52' via a series of angles or stops welded to the sheet in a manner (between plates 60' and supports 56') to allow expansion of the sheet 42 as needed. Expansion room under the ridge member 54' allows for expansion in this direction, and the ridge member 54' retaining the floor sheet. The outermost frame members 56' engage with floor sheet clips 62 that are welded to the floor sheet 42 to support and retain the floating floor sheet 42 in a manner allowing side to side expansion. In other words the clips 62 secure the floor sheet 42 but allow expansion side to side (as does the resting stops). The floor sheet 42 is thus floating on the end trough forming assembly 40

The design of the trough forming assemblies 40, in particular, and the bolting of the frame to the sidewall 26 to a lesser extent, allows for a distinct car to be easily converted in use to alternative trough configurations to accommodate other designated uses without substantial retrofitting of the car design.

The transverse trough coil car body 20 according to the present invention may further include floating trough floor pans extending between adjacent trough forming assemblies to complete the trough sections.

The troughs may include other coil engaging structure (not shown) such as wood supports to protect the coils and car cover structures over the car body, which also protect the coils.

A key feature of the present invention is the provision of a plurality of trough forming assemblies 40 and 40', with each trough forming assembly 40 and 40' including at least one floating floor sheet 42. Again, floating with regard to the floor sheets 42 of the present invention defines that the floor sheet 42 is coupled to the associated structure in a manner so as to accommodate thermal expansion in a length and width direction of the floor sheet 42. This design allows for the floor sheets 42 of the railcar to expand and contract as needed due to the thermal input associated with the loading and unloading of hot coils. By allowing the floor sheets 42 to free float as described the floor sheet thickness may be optimized and ⅜" plate may be effectively used. The design reduced stress concentrations due to thermal expansion and contraction and the premature fatigue that can occur with repeated cyclic loading of this type. These stresses can be evidenced in car as a whole and the present design is believed to increase the longevity of the trough and the car as a whole.

A preferred embodiment has been described in detail and a number of alternatives have been considered. As changes in or additions to the above described embodiments may be made without departing from the nature, spirit or scope of the invention, the invention is not to be limited by or to those details, but only by the appended claims and equivalents thereto.

What is claimed is:

1. A transverse trough coil car body including a plurality of transverse troughs along the car body, comprising:

a center sill extending substantially the longitudinal length of the car body;

a pair of side walls extending the longitudinal length of the car body on opposed sides of the car, each side wall including a side sill, top chord and side plate extending between the top chord and the side sill; and a plurality of trough forming assemblies, with each trough forming assembly including at least one floating floor sheet configured to allow for thermal expansion of the floor sheet in at least one of a longitudinal direction and a direction transverse to the longitudinal direction.

2. The transverse trough coil car body according to claim 1 wherein in at least a plurality of the trough forming assemblies a plurality of floor plate supporting gussets are positioned substantially parallel to each other and with a longitudinal axis of the car body.

3. The transverse trough coil car body according to claim 1 wherein in each trough forming assembly includes at least one base member and one ridge member extending across the car body.

4. The transverse trough coil car body according to claim 3 wherein in each floating floor sheet includes a pair of clips at opposed ends of the sheet for coupling the floor sheet to the trough forming assembly and allowing for thermal expansion.

5. The transverse trough coil car body according to claim 4 wherein each trough forming assembly is bolted to each side wall.

6. The transverse trough coil car body according to claim 1 wherein a plurality of trough forming assemblies include two floating floor plates.

7. The transverse trough coil car body according to claim 1 further including at least one trough floor pan extending between adjacent trough forming assemblies.

8. A transverse trough coil car body including a plurality of transverse troughs along the car body, comprising:

a pair of side walls extending the longitudinal length of the car body on opposed sides of the car, each side wall including a side sill, top chord and side plate extending between the top chord and the side sill; and a plurality of trough forming assemblies, with each trough forming assembly including at least one floating floor sheet which is coupled to the trough forming assembly configured to allow thermal expansion of the floor sheet in a first direction along a longitudinal axis of the car body and in a second direction transverse to the longitudinal axis of the car body.

9. The transverse trough coil car body according to claim 8, wherein each floating floor sheet extends from a base member of the trough forming assembly to a ridge member of the trough forming assembly.

10. The transverse trough coil car body according to claim 9, wherein each trough forming assembly includes a plurality of spaced frame supports extending between at least one base member thereof and the ridge member thereof.

11. The transverse trough coil car body according to claim 10, wherein each trough forming assembly includes a plurality of spaced gussets with each gusset positioned at a location of one of the frame supports, and wherein the gussets extend generally along the longitudinal axis of the car body.

12. The transverse trough coil car body according to claim 11, wherein each floating floor sheet includes a series of stops coupled to the sheet and wherein each floor sheet is supported on the base member via the series of stops which allow for thermal expansion of the floor sheet.

13. The transverse trough coil car body according to claim 12, wherein expansion room for each floating floor sheet is provided under the ridge member, and wherein the ridge member overlaps the floating floor sheet and allows for expansion of the floating floor sheet in the first direction along a longitudinal axis of the car body.

14. The transverse trough coil car body according to claim 13, wherein each floating floor sheet includes clips configured to engage a plurality of frame members which allow for thermal expansion of the floor sheet.

15. The transverse trough coil car body according to claim 14, wherein each floating floor sheet engage with the frame members in a manner configured to support and retain the floating floor sheets and allow expansion in the second direction transverse to the longitudinal axis of the car body.

16. The transverse trough coil car body according to claim 15, wherein a plurality of the trough forming assemblies include a triangular frame in which the apexes of which are generally formed by two of the base members and the ridge member.

17. The transverse trough coil car body according to claim 16, further including trough floor pans extending between adjacent trough forming assemblies.

18. The transverse trough coil car body according to claim 17, wherein each floating floor sheet is formed from ⅝" ASTM A-572 Grade 60 plate product.

19. The transverse trough coil car body according to claim 18, wherein each trough assembly is bolted to the sidewalls.

20. A transverse trough coil car comprising:

At least two spaced trucks;

A car body supported on the trucks and including a plurality of transverse troughs along the car body, the car body including:

i) a center sill extending substantially the longitudinal length of the car body, ii) a pair of side walls extending the longitudinal length of the car body on opposed sides of the car, each side wall including a side sill, top chord and side plate extending between the top chord and the side sill; and iii) a plurality of trough forming assemblies, with each trough forming assembly including at least one floating floor sheet which is coupled to trough forming assembly and structured to allow for thermal expansion in a first direction along a longitudinal axis of the car body and in a second direction transverse to the longitudinal axis of the car body.

* * * * *